US007002132B2

(12) United States Patent
Negi et al.

(10) Patent No.: US 7,002,132 B2
(45) Date of Patent: Feb. 21, 2006

(54) PHOTOCATHODE, ELECTRON TUBE, AND METHOD OF ASSEMBLING PHOTOCATHODE

(75) Inventors: Yasuharu Negi, Hamamatsu (JP); Yasuyuki Egawa, Hamamatsu (JP); Toru Hirohata, Hamamatsu (JP); Minoru Niigaki, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 169 days.

(21) Appl. No.: 10/704,695

(22) Filed: Nov. 12, 2003

(65) Prior Publication Data

US 2004/0094694 A1 May 20, 2004

(30) Foreign Application Priority Data

Nov. 13, 2002 (JP) ..... P2002-329750

(51) Int. Cl.
*H01J 40/14* (2006.01)

(52) U.S. Cl. ..... 250/214 VT; 250/207; 313/532

(58) Field of Classification Search ..... 250/214 VT, 250/207; 313/532, 533, 324, 91, 542
See application file for complete search history.

(56) References Cited

U.S. PATENT DOCUMENTS

| | | | | |
|---|---|---|---|---|
| 5,680,007 | A | 10/1997 | Niigaki et al. | |
| 5,742,115 | A * | 4/1998 | Gertsenshteyn | 313/365 |
| 5,917,282 | A * | 6/1999 | Suyama et al. | 313/544 |
| 6,040,657 | A * | 3/2000 | Vrescak et al. | 313/544 |
| 6,297,489 | B1 * | 10/2001 | Suyama et al. | 250/207 |
| 6,551,162 | B1 * | 4/2003 | Pruet et al. | 445/50 |
| 2003/0146698 | A1 | 8/2003 | Ohtomo et al. | |

FOREIGN PATENT DOCUMENTS

| | | |
|---|---|---|
| JP | 8-255580 | 10/1996 |
| JP | 2002-42636 | 2/2002 |

* cited by examiner

*Primary Examiner*—David Porta
*Assistant Examiner*—Kevin Wyatt
(74) *Attorney, Agent, or Firm*—Drinker Biddle & Reath LLP

(57) ABSTRACT

The invention relates to a photocathode and the like having such structure for holding a photocathode plate on a light transparent member with good reliability and workability. In the photocathode, claw portions of a holding member fixed to the light transparent member is pressed against the lower surface of a supporting plate so that a photocathode plate is sandwiched between the light transparent member and the supporting plate. Thus, the supporting plate is pressed against the photocathode plate, so that the photocathode plate is pressed against the light transparent plate by the supporting plate. This allows the photocathode plate to be held reliably by the light transparent member. This simple configuration further provides good workability in assembling.

9 Claims, 7 Drawing Sheets

PHOTOCATHODE, ELECTRON TUBE, AND METHOD OF ASSEMBLING PHOTOCATHODE

BACKGROUND OF THE INVENTION

1. Field of the Invention

The present invention relates to a photocathode in which light transmitted through a light transparent member is incident on a photocathode plate so that photoelectrons are emitted, an electron tube including the photocathode, and a method of assembling the photocathode.

2. Related Background Art

Such techniques according to the prior art include an electron tube disclosed in Japanese Patent Laid-Open No. 2002-42636 (Reference 1). In the electron tube disclosed in Reference 1, a photocathode plate is sandwiched between a faceplate and a supporting plate, and a pin embedded in the faceplate is joined with the supporting plate, so that the photocathode plate is fixed to the faceplate. In a case where this electron tube is used as a field assist type photocathode for detecting light with a long wavelength, when the pin and the supporting plate are formed of conductive materials, a bias voltage can be applied to the photocathode plate through the pin and the supporting plate.

A field assist type photocathode described above is also disclosed, for example, in Japanese Patent Laid-Open No. Hei 8-255580 (Reference 2). The photocathode plate of the field assist type photocathode disclosed in Reference 2 is fixed to the inner surface of the body of an electron tube by means of adhesive.

SUMMARY OF THE INVENTION

The inventors have studied conventional electron tubes in detail. As a result, they have found problems as follows. That is, in the electron tube disclosed in Reference 1, meticulous care of work is necessary in the formation of a through hole in the faceplate and in the embedding of a pin therein. This causes a certain decrease in workability. In the electron tube disclosed in Reference 2, temperature change and the like can cause degradation in the adhesive so that the photocathode plate can drop off in worst case scenarios.

The invention has been devised in order to resolve these problems. An object of the invention is to provide a photocathode, an electron tube, and a method of assembling a photocathode, in which a photocathode plate is held by a light transparent member with good reliability and workability.

In order to achieve this object, a photocathode according to the present invention comprises a light transparent member, a photocathode plate, a holding member, a supporting plate. The light transparent member has a first surface incident with light with a predetermined wavelength, and a second surface opposing the first surface and emitting the light. The photocathode plate is arranged at the second surface side of the light transparent member. The photocathode plate functions so as to receive the light passing through the light transparent member and emitting photoelectrons in response to incidence of light. The holding member is attached to the second surface of the light transparent member, and has a first opening portion in which the photocathode plate is disposed. The supporting plate is arranged so as to sandwich the photocathode plate together with the second surface of the light transparent member, and has a second opening portion for exposing a part of said photocathode plate so as to allow the photoelectrons from the photocathode plate to pass therethrough. In particular, in the photocathode according to the present invention, the holding member has a fixing structure folded so as to be pressed against the supporting plate in order to press the supporting plate against the photocathode plate.

In the photocathode, the fixing structure of the holding member attached to the light transparent member is pressed against the supporting plate so that the photocathode plate is sandwiched between the light transparent member and the supporting plate. Thus, the supporting plate is pressed against the photocathode plate, so that the photocathode plate is pressed against the light transparent member by the supporting plate. This allows the photocathode plate to be held reliably by the light transparent member. This simple configuration further provides good workability in assembling. Furthermore, the fixing structure of the holding member is not directly pressed against the photocathode plate, but the supporting plate intervenes between the folded portion of the fixing structure and the photocathode plate. This prevents the occurrence of damage to the photocathode plate.

Preferably, the fixing portion includes a plurality of the claw portions provided on the holding member such as to surround the supporting plate at even intervals. The plurality of the claw portions provided such as to surround the supporting plate at even intervals are pressed against the supporting plate. This allows the supporting plate to be pressed against the photocathode plate with uniform load distribution. This permits more stable retention of the photocathode plate.

The photocathode plate is preferably fitted within the first opening portion of the holding member. This configuration simplifies notably the work of assembling and positioning the photocathode plate during the assembly of the photocathode, and hence improves the efficiency in the assembly work of the photocathode. Further, this configuration prevents horizontal-directional misalignment of the photocathode plate.

The holding member preferably has an annular encircling portion for encircling the photocathode plate, so that the supporting plate is fitted within the encircling portion. This configuration simplifies notably the work of assembling and positioning the supporting plate during the assembly of the photocathode, and hence improves the efficiency in the assembly work of the photocathode. Further, in a case where the supporting plate is arranged close to the encircling portion, during the process that an alkaline metal or the like for reducing the work function and thereby permitting easy emission of photoelectrons is vapor-deposited onto the electron emitting surface of the photocathode plate exposed from the second opening portion of the supporting plate, the alkaline metal is prevented from being deposited onto the side surface of the photocathode plate.

The photocathode according to the present invention may have a first conductive film electrically connected to the photocathode plate. The first conductive film is provided on the second surface of the light transparent member, so that a voltage is applied through the first conductive film to the photocathode plate. In accordance with this configuration, in a case where, for example, a minus terminal of a power supply for voltage applying is connected to the first conductive film, electrical connection is established between the photocathode plate and the minus terminal of the power supply for voltage applying. This eliminates the necessity of access using a wire, a pin, or the like to a minus terminal provided in contact with the light incident surface of the photocathode plate. This prevents an increase in the complexity in the photocathode.

It is preferable that the holding member is formed of a conductive material, and electrically connected to the first conductive film, so that a voltage is applied through the holding member and the first conductive film to the photocathode plate. By this configuration, in a case where, for example, a minus terminal of a power supply for applying a voltage is connected to the holding member, electrical connection is established between the photocathode plate and the minus terminal of the power supply. This eliminates the necessity of access using a wire, a pin, or the like to a minus terminal provided in contact with the light incident surface of the photocathode plate. This prevents an increase in the complexity in the photocathode.

A bias voltage may be applied between both sides of the photocathode plate. By this configuration, in a case where, for example, a minus terminal of a bias power supply for applying a bias voltage is connected to the holding member, electrical connection is established between the photocathode plate and the minus terminal of the bias power supply. Thus, even in a case where the photocathode is used as a field assist type, this configuration eliminates the necessity of access using a wire, a pin, or the like to a negative electrode provided in contact with the light incident surface of the photocathode plate. This prevents an increase in the complexity in the photocathode.

The supporting plate preferably has a second conductive film electrically connected to the photocathode plate. The second conductive film is formed on the supporting plate so as to continue from one surface contacting with the photocathode plate to the other surface thereof opposing the one surface via the wall surface defining the second opening portion, so that a voltage is applied through the second conductive film to the photocathode plate. By this configuration, in a case where, for example, a plus terminal of a bias power supply for applying a bias voltage is connected to the second conductive film formed on the other surface of the supporting plate, electrical connection is established between the photocathode plate and the plus terminal of the bias power supply. Thus, even in a case where the photocathode is used as a field assist type, this configuration eliminates the necessity of access using a wire, a pin, or the like to a plus terminal provided in contact with the photoelectron emitting surface of the photocathode plate. This prevents an increase in the complexity in the photocathode.

An electron tube according to the present invention includes the above-mentioned photocathode.

In the photocathode applied to the electron tube according to the present invention, the claw portions of the holding member attached to the light transparent member are pressed against the supporting plate so that the photocathode plate is sandwiched between the light transparent member and the supporting plate, so that the photocathode plate is held reliably by the light transparent member. This eliminates the necessity for use of an adhesive for holding the photocathode plate, and hence prevents degradation in vacuum pressure in the electron tube that could be caused by the generation of gas from the adhesive. The electron tube in this specification indicates an apparatus that detects a weak light by using a photocathode, and includes a photomultiplier, a streak tube, and an image intensifier, and the like.

A photocathode assembling method according to the present invention assemblies a photocathode in which light transmitted through a light transparent member is incident on a photocathode plate so that photoelectrons are emitted from the photocathode plate. The method comprises the steps of attaching, to one surface of the light transparent member, a holding member with a first opening portion in which the photocathode plate is disposed, sandwiching the photocathode plate between a supporting plate with a second opening portion for allowing the photoelectrons from the photocathode plate to pass therethrough, as well as the one surface of the light transparent member; and folding claw portions provided on the holding member so as to press the claw portions against the supporting plate in order to press the supporting plate against the photocathode plate.

In accordance with the photocathode assembling method, for example, the holding member is attached to the one surface of the light transparent member, and then the photocathode plate is sandwiched between the one surface of the light transparent member and the supporting plate. After that, the claw portions provided on the holding member are pressed against the supporting plate. Such notably simple work allows the photocathode plate to be held reliably by the light transparent member. This improves the efficiency in the assembly work of the photocathode. Alternatively, the photocathode plate may first be sandwiched between the light transparent member and the supporting plate, and then the holding member may be attached to the light transparent member.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

Preferred embodiments of a photocathode, a method for assembling a photocathode, and an electron tube according to the present invention are described below in detail with reference to the drawings.

Figure 1:
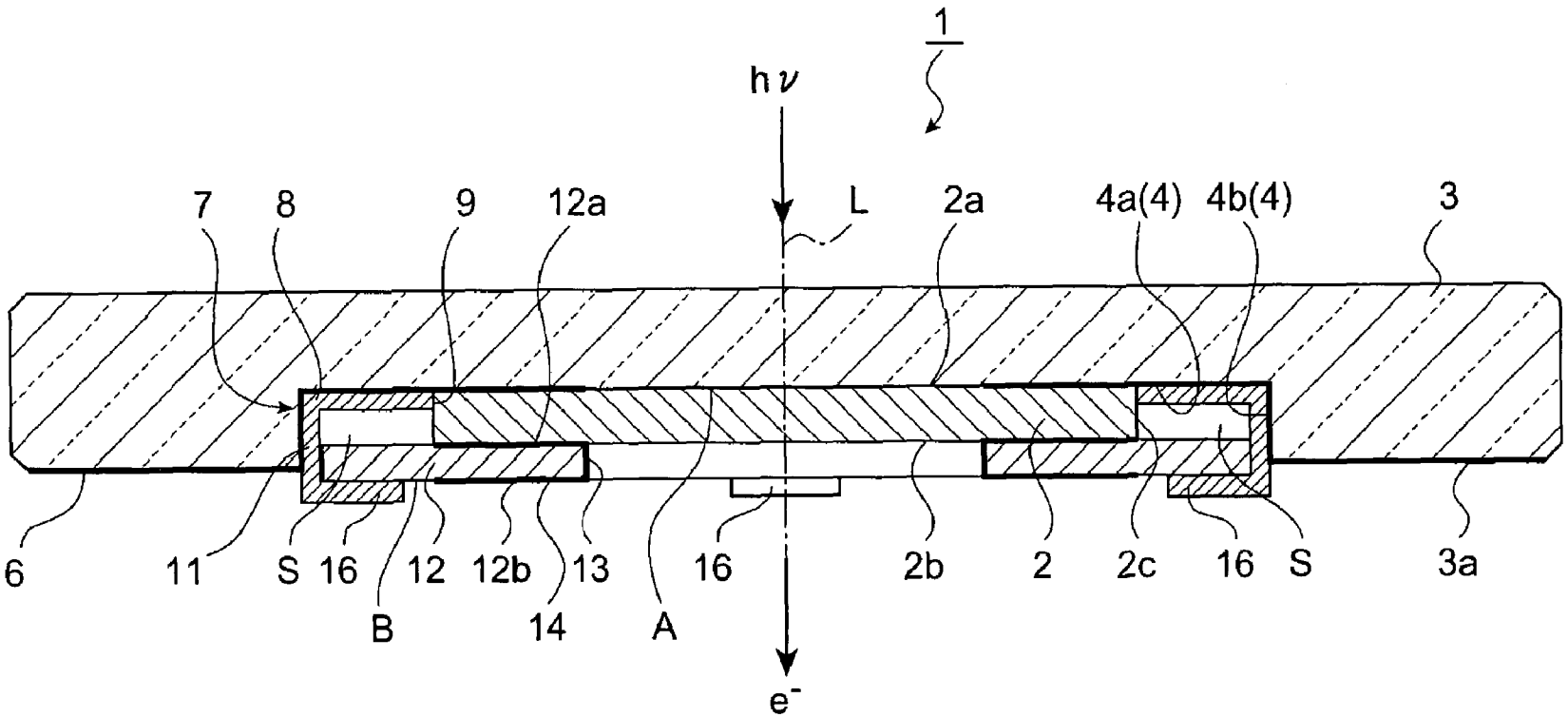
FIG. 1 is a cross sectional view showing an embodiment of a photocathode according to the invention.
Figure 2:
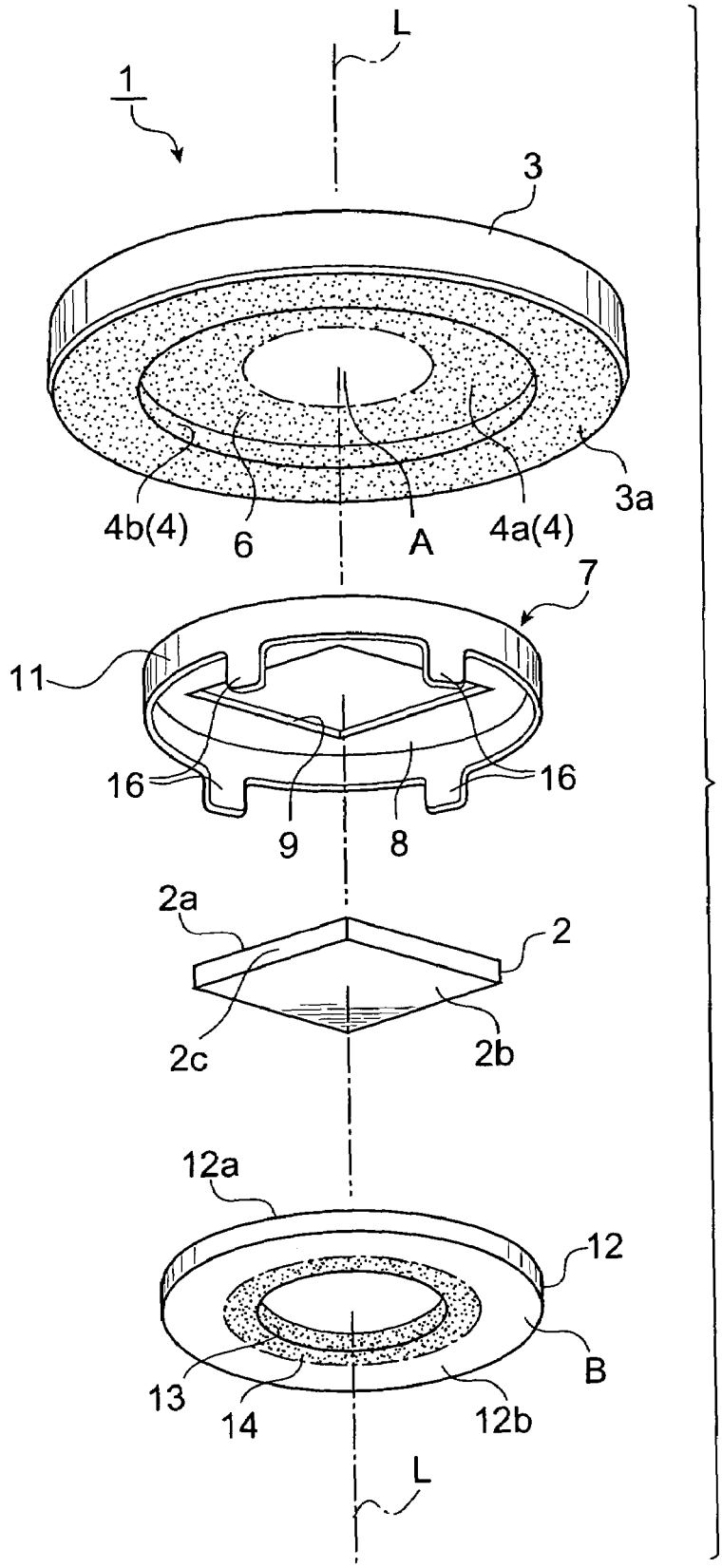
FIG. 2 is an exploded perspective view showing the photocathode of FIG. 1.
Figure 3:
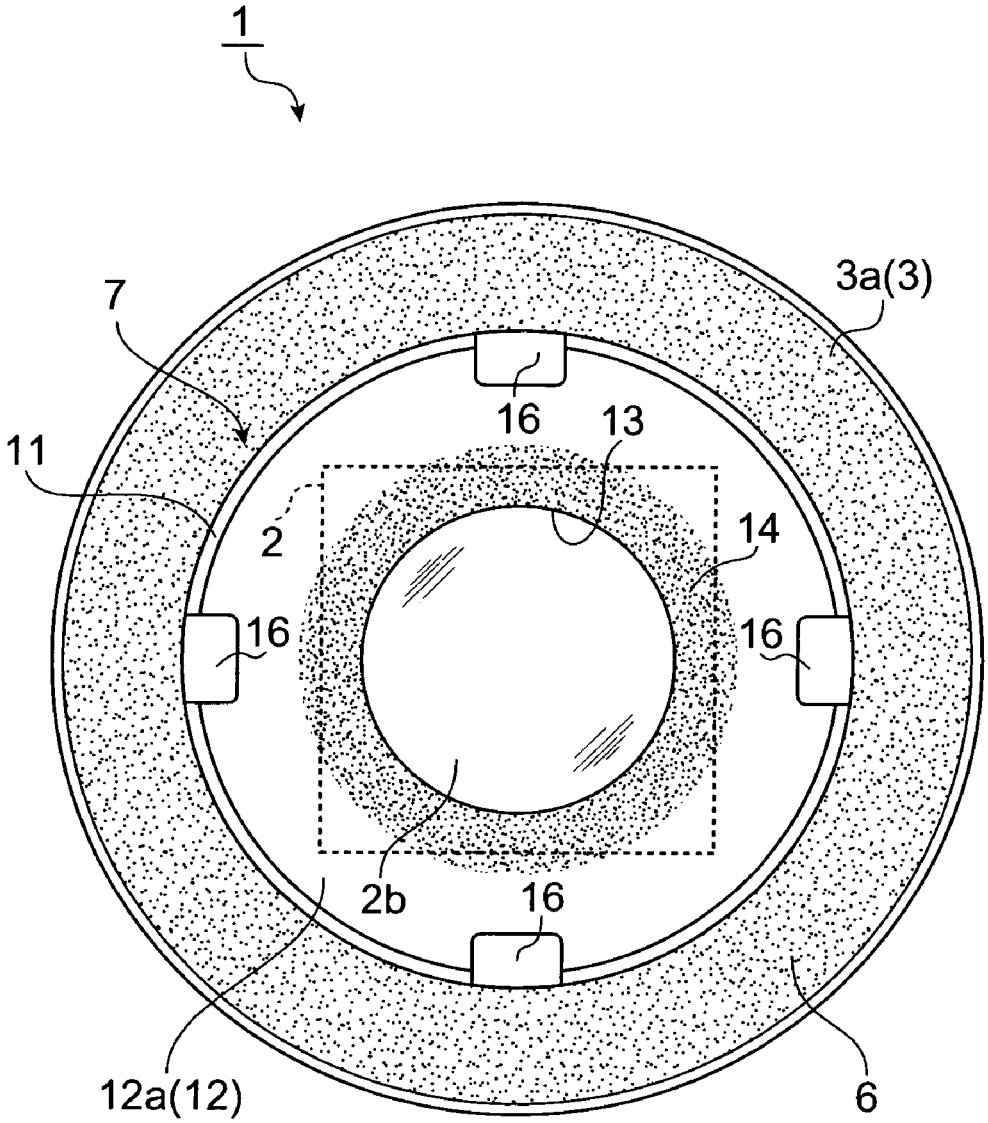
FIG. 3 is a bottom view showing the photocathode of FIG. 1.

FIG. 1 is a cross sectional view showing an embodiment of a photocathode according to the invention, FIG. 2 is an exploded perspective view showing the photocathode of FIG. 1, and FIG. 3 is a bottom view showing the photocathode of FIG. 1. The photocathode 1 shown in FIG. 1 is a transmission type field assist photocathode comprising a photocathode plate (a semiconductor crystal functioning as a so-called photoelectric surface) 2 for emitting photoelectrons ($e^-$) toward the rear direction (downward) in response to light (hv) incident from the front direction (from above). This photocathode 1 is used as a photoelectric conversion portion in an electron tube such as a photomultiplier. The photocathode 1 comprises a disk-shaped light transparent plate (light transparent member) 3 formed of silica glass. A circular recess 4 having its center on an axis line L is formed in the lower surface 3*a* of the light transparent plate 3.

As shown in FIG. 1 and FIG. 2, a first conductive film 6 composed of Cr is formed on the bottom surface 4*a* of the recess 4 except in a circular light transmitting region A having its center on the axis line L. The first conductive film 6 extends uniformly from the bottom surface 4*a* of the recess 4 to the side surface 4*b* and further to the lower surface 3*a* (a dotted region in FIG. 2). Thus, the light (hv) to be transmitted through the light transparent plate 3 passes through the light transmitting region A of the bottom surface 4*a*. As for the material for the first conductive film 6, Cr, Ti, and Cu are preferable because these materials adhere well to the silica glass and are not easily peeled off. However, any other conductive materials may be used.

A holding member 7 composed of Kovar for holding the photocathode plate 2 is fitted into the recess 4 in the light transparent plate 3. The holding member 7 comprises a thin-disk shaped holding portion 8 in contact with the bottom surface 4*a* of the recess 4, while the holding portion 8 and the conductive film 6 formed on the bottom surface 4*a* are joined together using indium (In), so that the holding member is firmly fixed to the light transparent plate 3. Even a holding member 7 composed of Ni can be firmly fixed by the joining using indium (In).

In the holding portion 8, a first opening portion 9 is formed into the shape of a rectangle broader than the light transmitting region A. The photocathode plate 2 having the shape of a thin rectangular plate having the same cross section as the first opening portion 9 viewed from the direction along the axis line L is fitted into the first opening portion 9 such as to contact with the light transparent member 3. As a result, the light incident surface 2*a* of the photocathode plate 2 is electrically connected to the first conductive film 6 exposed from the first opening portion 9 of the holding portion 8.

An annular encircling portion 11 for fitting to the side surface 4*b* of the recess 4 is integrally formed at the outer periphery of the holding portion 8. The encircling portion 11 encircles the photocathode plate 2 with a space S between this encircling portion 11 and the side surface 2*c* of the photocathode plate 2. A ceramic supporting plate 12 having the shape of a disk having the same cross section as the inner surface of the encircling portion 11 viewed from the direction along the axis line L is fitted into the encircling portion 11 so as to contact with the photocathode plate 2. In the supporting plate 12, a second opening portion 13 is formed for allowing photoelectrons ($e^-$) emitted from the electron emitting surface 2*b* of the photocathode plate 2 to pass therethrough.

A second conductive film 14 composed of Cr is formed in the periphery of the second opening portion 13 of the supporting plate 12 (a dotted region in FIG. 2). The second conductive film 14 is formed so as to continue from the upper surface 12*a* to the lower surface 12*b* of the supporting plate 12 via the wall surface defining the second opening portion 13. On the upper surface 12*a* side, this second conductive film is electrically connected to the electron emitting surface 2*b* of the photocathode plate 2. As for the material for the second conductive film 14, Cr, Ti, and Ag are preferable because these materials do not generate any gas causing degradation in the vacuum pressure in the electron tube. However, any other conductive materials may be used.

In the lower end portion of the encircling portion 11, four claw portions 16 are integrally formed at even intervals (every 90 degrees) with their center on the axis line L. As shown in FIG. 1 and FIG. 3, the claw portions 16 are folded at right angles toward the axis line L so as to be pressed against the electrically non-conductive region B (the region where the second conductive film 14 is not formed) in the outer periphery of the lower surface 12*b* of the supporting plate 12, so as to press the supporting plate 12 against the photocathode plate 2. The number of the claw portions 16 is not limited to four. For example, a pair of opposing claw portions 16 may be formed in the lower end portion of the encircling portion 11.

In the photocathode 1 having the above-mentioned configuration, the claw portions 16 of the holding member 7 fixed to the light transparent plate 3 are pressed against the lower surface 12*b* of the supporting plate 12, so that the photocathode plate 2 is sandwiched between the light transparent member 3 and the supporting plate 12. As a result, the supporting plate 12 is pressed against the photocathode plate 2, so that the photocathode plate 2 is pressed against the light transparent member 3 by the supporting plate 12. This allows the photocathode plate 2 to be held reliably by the light transparent plate 3.

The holding member 7 is composed of a conductive material called Kovar, and is electrically connected through the first conductive film 6 to the light incident surface 2*a* of the photocathode plate 2. However, the claw portions 16 of the holding member 7 press the photocathode plate 2 via the supporting plate 12 composed of ceramic serving as an electrically insulating material from the electron emitting surface 2*b* side. This prevents electrical conduction between the light incident surface 2*a* and the electron emitting surface 2*b* of the photocathode plate 2 via the holding member 7.

Further, the claw portions 16 do not directly press the electron emitting surface 2*b* of the photocathode plate 2, but the ceramic supporting plate 12 intervenes between the claw portions 16 and the photocathode plate 2 so as to establish plane contact between the photocathode plate 2 and the supporting plate 12. This prevents the occurrence of damage to the photocathode plate 2.

Additionally, the four claw portions 16 are formed such as to surround the supporting plate 12 at even intervals, and are then pressed against the supporting plate 12. Thus, the supporting plate 12 is pressed against the photocathode plate 2 with uniform load distribution. This permits stable retention of the photocathode plate 2.

Figure 4:
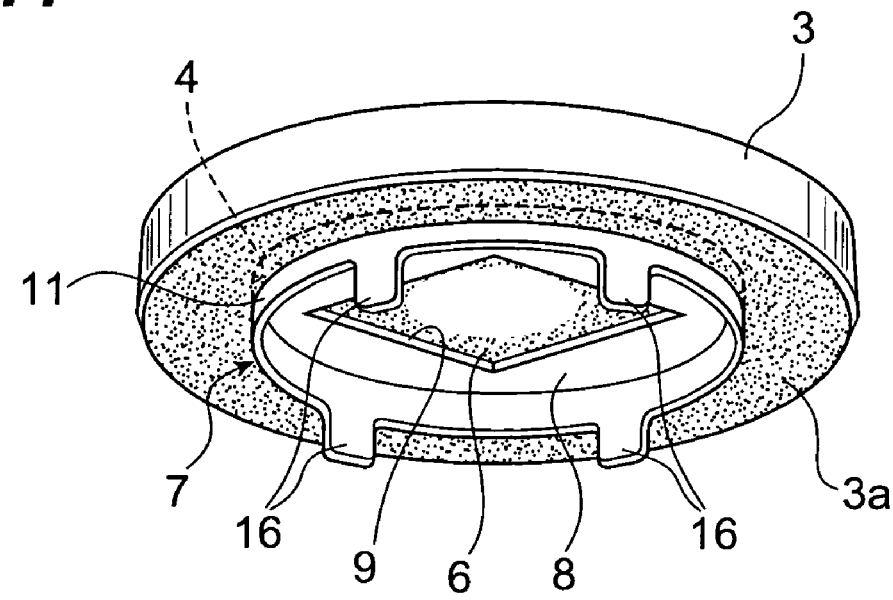
FIG. 4 is a perspective view showing the state where a holding member is fitted into a recess of a light transparent plate.

Next, method of assembling the above-mentioned photocathode 1 will explained below in reference to FIGS. 4–7. FIG. 4 is a perspective view showing the state where a holding member is fitted into a recess of a light transparent plate, FIG. 5 is a perspective view showing the state where a photocathode plate is fitted into an opening portion of a holding member, FIG. 6 is a perspective view showing the state where a supporting plate is fitted into an encircling portion of a holding member, and FIG. 7 is a perspective view showing the state where claw portions of a holding member are folded such as to be pressed against a supporting plate.

First, in the light transparent plate 3, Cr is vapor-deposited on the lower surface 3*a*, on the bottom surface 4*a* of the recess 4 except in the light transmitting region A, and on the side surface 4*b* of the recess 4, so as to form the first conductive film 6. Similarly, Cr is vapor-deposited in the predetermined region in the side periphery of the second opening portion 13 of the supporting plate 12, so as to form the second conductive film 14. After the formation of the conductive films 6 and 14, as shown in FIG. 4, the holding member 7 is fitted into the recess 4 of the light transparent plate 3, and then the holding portion 8 of the holding member 7 and the bottom surface 4*a* of the recess 4 are joined together using indium (In), so that the holding member 7 is fixed to the light transparent plate 3. At that time, the claw portions 16 of the holding member 7 are not folded but maintained such as to extend straight downward.

Figure 5:
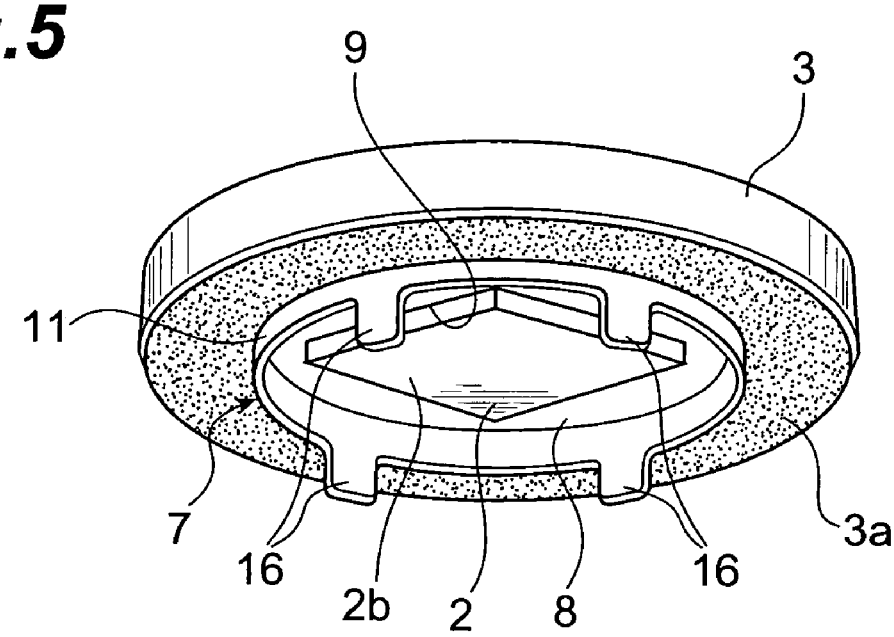
FIG. 5 is a perspective view showing the state where a photocathode plate is fitted into an opening portion of a holding member.

Afterwards, as shown in FIG. 5, the photocathode plate 2 is fitted into the first opening portion 9 of the holding member 7, so that the light incident surface 2*a* of the photocathode plate 2 is electrically connected to the first conductive film 6 formed on the light transparent plate 3. This notably simple work of fitting the photocathode plate 2 into the first opening portion 9 achieves the assembling and the positioning of the photocathode plate 2 as well as the electrical connection between the light incident surface 2*a* and the first conductive film 6. Furthermore, this prevents horizontal-directional misalignment of the photocathode plate 2.

Figure 6:
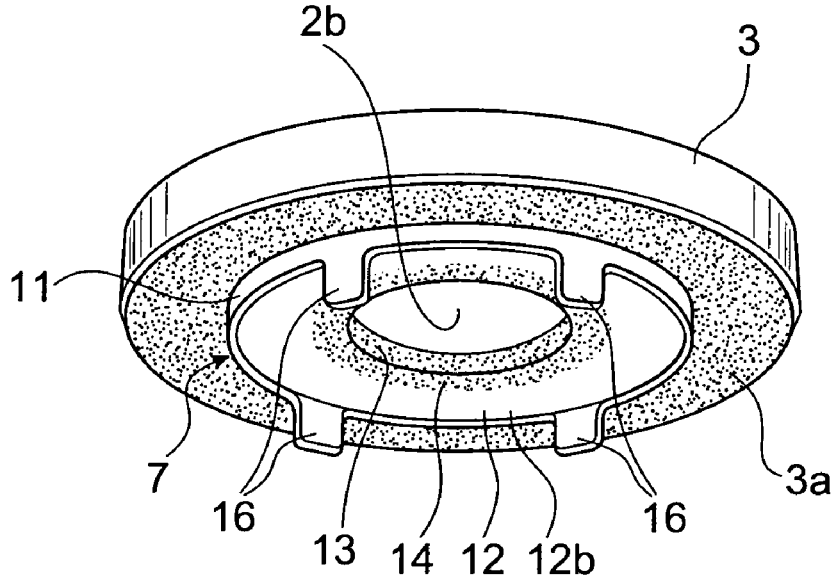
FIG. 6 is a perspective view showing the state where a supporting plate is fitted into an encircling portion of a holding member.
Figure 7:
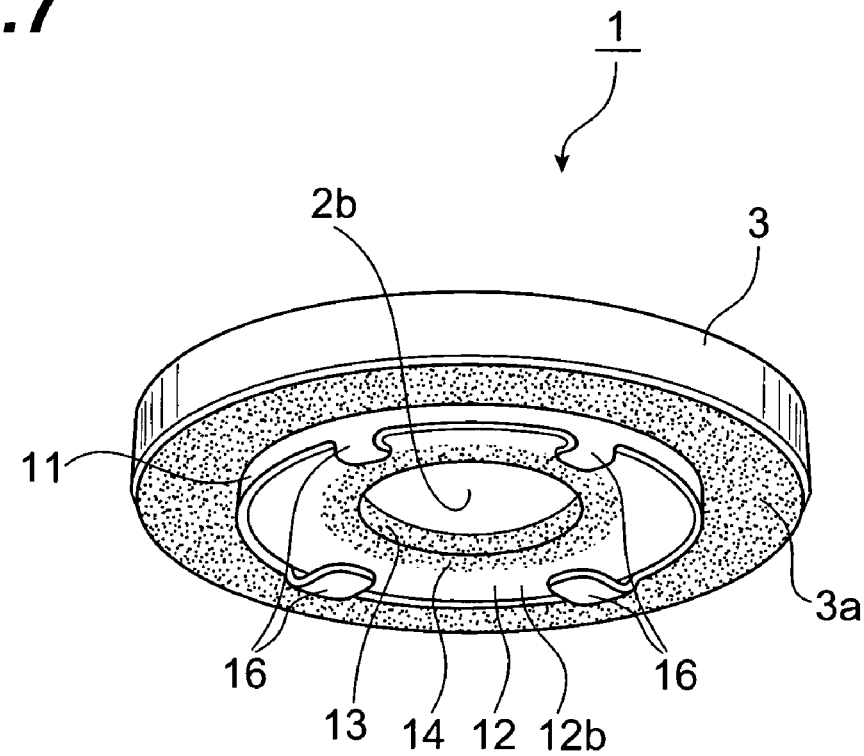
FIG. 7 is a perspective view showing the state where claw portions of a holding member are folded such as to be pressed against a supporting plate.

After the fitting of the photocathode plate 2, as shown in FIG. 6, the supporting plate 12 is fitted into the encircling portion 11 of the holding member 7, so that the electron emitting surface 2*b* of the photocathode plate 2 is electrically connected to the second conductive film 14 formed on the upper surface 12*a* of supporting plate 12. This notably simple work of fitting the supporting plate 12 into the encircling portion 11 achieves the assembling and the positioning of the supporting plate 12 as well as the electrical connection between the electron emitting surface 2*b* and the second conductive film 14. Then, as shown in FIG. 7, the claw portions 16 of the holding member 7 are folded so as to be pressed against the lower surface 12*b* of the supporting plate 12, so as to press the supporting plate 12 against the photocathode plate 2, so that the photocathode plate 2 is retained in the light transparent plate 3.

As a final step, an alkaline metal such as Cs (or alternatively an oxide thereof) for reducing the work function and thereby permitting easy emission of photoelectrons ($e^-$) is vapor-deposited onto the electron emitting surface 2*b* of the photocathode plate 2. At this time, as shown in FIG. 1, the side surface 2*c* of the photocathode plate 2 contacting with the light transparent plate 3 is covered with the encircling portion 11 and the supporting plate 12. This prevents the entering of the alkaline metal vapor into the space S formed between the encircling portion 11 and the side surface 2*c* of the photocathode plate 2. Accordingly, an alkaline metal layer is formed on the electron emitting surface 2*b* only in the region exposed from the second opening portion 13 of the supporting plate 12, while the alkaline metal is not deposited on the side surface 2*c*. This prevents a short circuit between the light incident surface 2*a* and the electron emitting surface 2*b* formed via the side surface 2*c*. When a ceramic material having a rough surface is used as the supporting plate 12, the electric resistance of the supporting plate 12 is maintained at a high value even in a case where the alkaline metal is deposited onto the surface of the supporting plate 12. This prevents a short circuit between the light incident surface 2*a* and the electron emitting surface 2*b* formed via the supporting plate 12 and the holding member 7.

In accordance with the method of assembling the photocathode 1, the holding member 7 is fixed to the light transparent plate 3, and then the photocathode plate 2 is sandwiched between the light transparent plate 3 and the supporting plate 12. After that, the claw portions 16 of the holding member 7 is pressed against the supporting plate 12. Such notably simple work allows the photocathode plate 2 to be retained reliably in the light transparent plate 3. This improves the efficiency in the assembly work of the photocathode 1.

For the purpose of ensuring electrical connection, the light incident surface 2*a* and the conductive film 6 may be joined together using indium (In). Similarly, the electron emitting surface 2*b* and the conductive film 14 may be joined together using indium (In). In the photocathode 1, this joining may be conducted using another low melting point metal other than indium (In).

Figure 8:
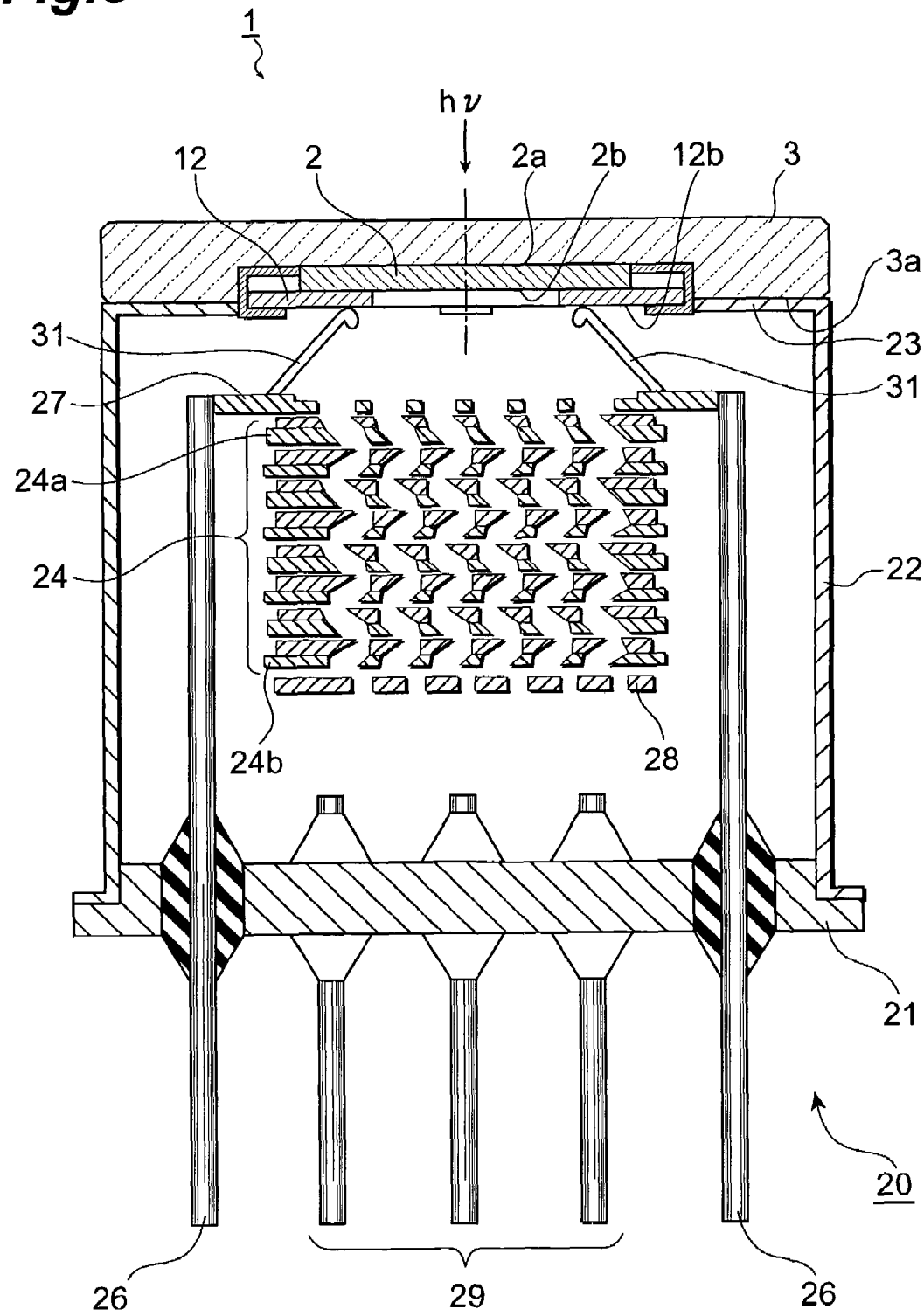
FIG. 8 is a cross sectional view showing a photomultiplier serving as an embodiment of an electron tube according to the invention.

Next, a photomultiplier functioning as an electron tube comprising the above-mentioned photocathode 1 will be explained below in reference to FIG. 8. FIG. 8 is a cross sectional view showing a photomultiplier serving as an embodiment of an electron tube according to the invention.

As shown in FIG. 8, in a photomultiplier 20, a side tube 22 composed of metal is air-tightly fixed to a stem 21 composed of metal, while a photocathode 1 is air-tightly fixed to the top end portion of the tube body 22, so that a vacuum chamber is formed. The fixing between the tube body 22 and the photocathode 1 is achieved by joining, using indium (In), an inward flange portion 23 formed in the top end portion of the tube body 22 with the first conductive film 6 formed on the lower surface 3*a* of the light transparent member 3.

Metal channel dynodes 24 are deposited in the vacuum chamber formed as described above, while a mesh-shaped focusing electrode 27 connected to stem pins 26 is disposed between the metal channel dynodes 24 and the photocathode 1. Accordingly, photoelectrons ($e^-$) emitted from the photocathode plate 2 are converged on the first-stage dynode 24*a* of the metal channel dynodes 24 by the converging electrode 27. Then, the photoelectrons ($e^-$) undergo multiplication successively in the metal channel dynodes 24, so that a group of secondary electrons is emitted from the final-stage dynode 24*b*. The group of secondary electrons reaches an anode 28, and are then outputted to the outside via stem pins 29 connected to the anode 28

In the focusing electrode 27, a pair of contact electrodes 31 inclined inward and extending to the lower surface 12*b* of the supporting plate 12 are formed in an integrated manner. The top end portions of the contact electrodes 31 are pressed against and thereby connected to the second conductive film 14 formed on the lower surface 12*b* of the supporting plate 12.

According to the photomultiplier 20 having the above-mentioned configuration, when a negative electrode of a bias power supply for applying a bias voltage is connected to the tube body 22, the minus terminal is electrically connected through the first conductive film 6 to the light transmitting surface 2*a* of the photocathode plate 2. On the other hand, when a plus terminal of the bias power supply is connected to the stem pin 26, the plus terminal is electrically connected through the focusing electrode 27, contact electrodes 31, and the second conductive film 14, to the electron emitting surface 2*b* of the photocathode plate 2.

As such, this configuration eliminates the necessity of access using wires, pins, or the like to the bias voltage applying electrodes of the field assist type photocathode plate 2. This prevents an increase in the complexity in the photocathode 1, and permits size reduction in the photomultiplier 20. It should be noted that even when the minus terminal of the bias power supply is connected to the holding member 7, the minus terminal is electrically connected through the first conductive film 6 to the light transmitting surface 2*a*.

In the photomultiplier 20, there is no need for use of adhesive in the retention of the photocathode plate 2. This prevents degradation in vacuum pressure in the photomultiplier 20 that could be caused by generation of gas from the adhesive.

Figure 9:
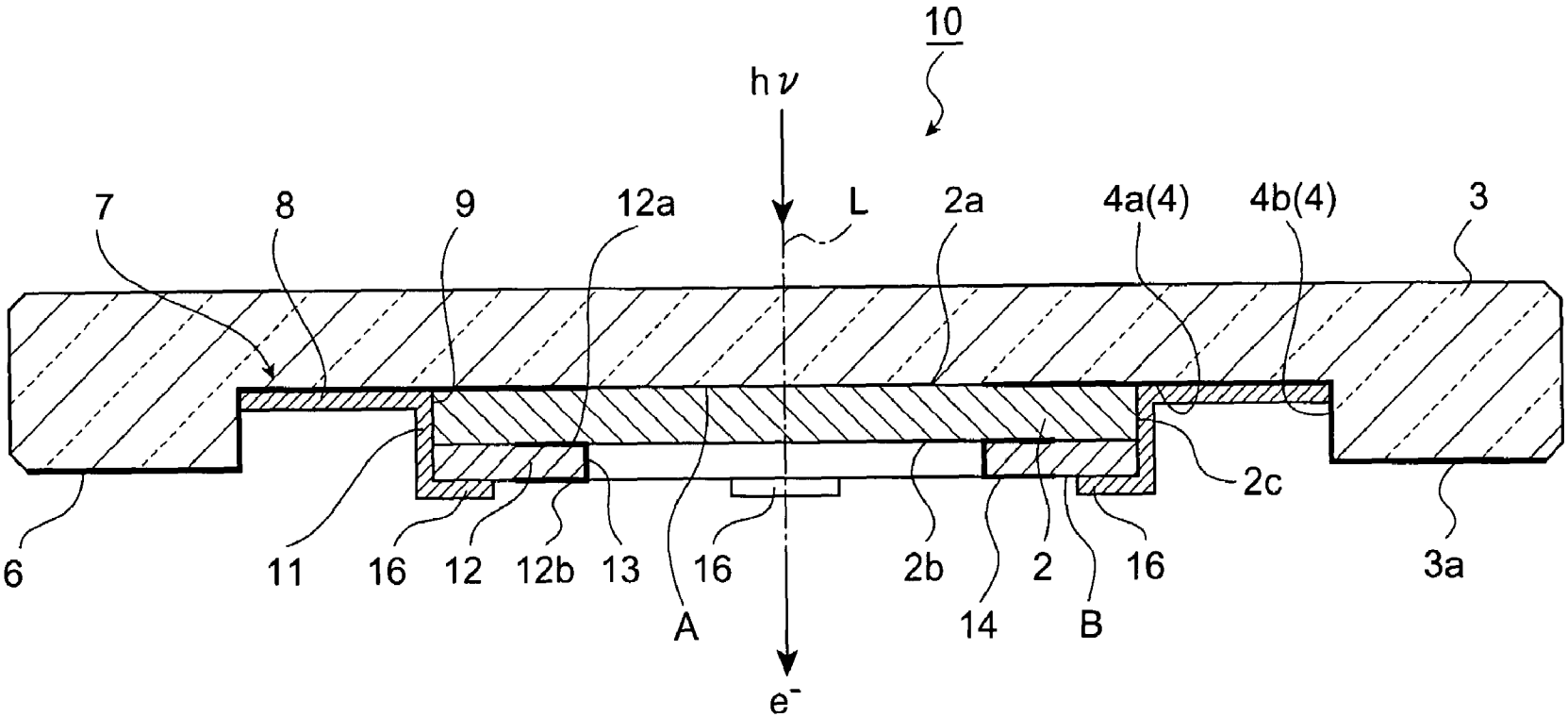
FIG. 9 is a cross sectional view showing another embodiment of a photocathode according to the invention.

The invention is not limited to these embodiments. For example, in the above-mentioned photocathode 1, the encircling portion 11 has been formed in an integrated manner in the periphery of the holding plate 8 of the holding member 7. However, as shown in a photocathode 10 of FIG. 9, an annular encircling portion 11 may be formed in an integrated manner in the periphery of an opening portion 9 of a holding plate 8. FIG. 9 is a cross sectional view showing another embodiment of a photocathode according to the invention. In this case, for the purpose of preventing a short circuit between the light transmitting surface 2*a* and the electron emitting surface 2*b* of the photocathode plate 2, an electrically insulating material (not shown) intervenes preferably between the side surface 2*c* of the photocathode plate 2 and the encircling portion 11.

Further, in the above-mentioned photocathode 1, the recess 4 has been formed in the lower surface 3*a* of the light transparent plate 3. However, even if such a recess 4 is not formed, the photocathode plate 2 can be held. Further, according to the photocathode of the invention, the photocathode plate can be retained in various types of photocathodes other than the field assist type photocathode. Furthermore, the photocathode of the invention is applicable also to various types of electron tubes including a streak tube and an image intensifier other than the photomultiplier 20.

As described above, in accordance with the photocathode, the electron tube, and the method of assembling the photocathode according to the present invention, claw portions of a holding member attached to a light transparent member are pressed against a supporting plate so that a photocathode plate is sandwiched between the light transparent member and the supporting plate. This permits the retention of the photocathode plate in the light transparent member with good reliability and workability.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photocathode comprising:

a light transparent member having a first surface incident with light with a predetermined wavelength, and a second surface opposing the first surface and emitting the light;

a photocathode plate arranged at the second surface side of said light transparent member, said photocathode plate receiving the light passing through said light transparent member and emitting photoelectrons in response to incidence of light;

a holding member attached to the second surface of said light transparent member and having a first opening portion in which said photocathode plate is disposed; and a supporting plate arranged so as to sandwich said photocathode plate together with the second surface of said light transparent member and having a second opening portion for exposing a part of said photocathode plate so as to allow the photoelectrons from said photocathode plate to pass therethrough, wherein said holding member has a fixing structure folded so as to be pressed against said supporting plate in order to press said supporting plate against said photocathode plate.

2. A photocathode according to claim 1, wherein the fixing structure of said holding member comprises a plurality of claw portions, said claw portions arranged on said holding member so as to surround said supporting plate at even intervals.

3. A photocathode according to claim 1, wherein said photocathode plate is fitted within said first opening portion of said holding member.

4. A photocathode according to claim 1, wherein said holding member has an annular encircling portion for encircling said photocathode plate, so that said supporting plate is fitted within said encircling portion.

5. A photocathode according to claim 1, further comprising a first conductive film electrically connected to said photocathode plate, said first conductive film being provided on the second surface of said light transparent member, so that a voltage is applied to said photocathode plate through said first conductive film.

6. A photocathode according to claim 5, wherein said holding member is composed of a conductive material and is electrically connected to said first conductive film, so that a voltage is applied to said photocathode plate through said holding member and said first conductive film.

7. A photocathode according to claim 1, wherein a bias voltage is applied between both surfaces of said photocathode plate.

8. A photocathode according to claim 7, further comprising a second conductive film electrically connected to said photocathode plate, said second conductive film being provided on said supporting plate so as to continue from one surface of said supporting plate contacting with said photocathode plate to the other surface of said supporting plate opposing the one surface via a wall surface of said supporting plate defining said second opening portion, so that a voltage is applied to said photocathode plate through said second conductive film.

9. An electron tube including a photocathode according to claim 1.

* * * * *